United States Patent [19]

Takahashi

[11] 4,262,984

[45] Apr. 21, 1981

[54] ELECTRIC CONTACT TERMINAL MEMBER

[75] Inventor: Toru Takahashi, Yokohama, Japan

[73] Assignee: Yamaichi Electric Mfg. Co., Ltd., Tokyo, Japan

[21] Appl. No.: 59,036

[22] Filed: Jul. 19, 1979

[30] Foreign Application Priority Data

Jul. 19, 1978 [JP] Japan ..... 53-87053

[51] Int. Cl.[3] ..... H01R 4/24

[52] U.S. Cl. ..... 339/97 R; 339/99 R

[58] Field of Search ..... 339/97 R, 97 P, 98, 339/99 R

[56] References Cited

U.S. PATENT DOCUMENTS

| | | | |
|---|---|---|---|
| 4,002,391 | 1/1977 | Dunn et al. | 339/98 |
| 4,106,837 | 8/1978 | Paluch | 339/98 |
| 4,136,920 | 1/1979 | Schultholt et al. | 339/98 |

FOREIGN PATENT DOCUMENTS

| | | | |
|---|---|---|---|
| 2337947 | 8/1977 | France | 339/98 |

*Primary Examiner*—Eugene F. Desmond

*Attorney, Agent, or Firm*—Wenderoth, Lind & Ponack

[57] ABSTRACT

In a press-in type terminal member for a single core cable, a temporary holding space is formed between contact arms and above a conductor press-in slot, to temporarily hold the cable before press-in operation. The terminal member may have an outward projection which forms another temporary holding space in cooperation with an adjacent terminal member, to hold another cable for a second row of terminals which is staggered from the first row of terminals.

4 Claims, 13 Drawing Figures

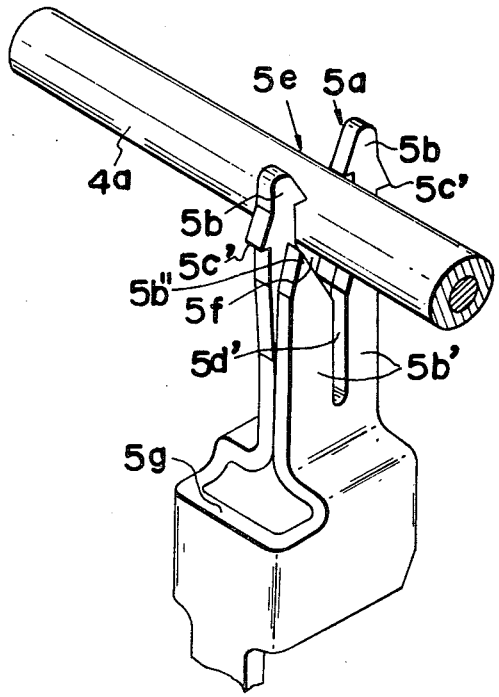

ELECTRIC CONTACT TERMINAL MEMBER

BACKGROUND OF THE INVENTION

The invention relates to an electric contact terminal member having at least one pair of contact arms which forms a conductor press-in slot therebetween for a single core cable.

When a connector has many conductor press-in type contact terminal members, each specific cable must be pressed in each conductor press-in slot of a specific terminal member. Thus the operation is tedious and time consuming. To press-in some of the cables, a special jig must be prepared to arrange and temporarily hold necessary cables. In this case, the jig must be removed from the completed connector, and when the holding of the jig is stable, the removing operation is not easy. Unstable cables tend to drop off or cause positioning errors.

SUMMARY OF THE INVENTION

The object of the present invention is to provide an electric contact terminal member of the type specified and having temporary holding means to hold the cable before the cable is pressed into the conductor press-in slot.

According to the present invention, the inlet portion of the conductor press-in slot between the contact arms of the terminal member is broadened to accommodate the cable without damaging the insulation thereof. The inlet end portion of the slot has projections to hold the cable. Thus, the broadened inlet portion and the projections cooperate to form a temporary holding space for the cable.

As the cable can be pushed into the temporary holding space, arrangement and positioning of the cable with a specific terminal member is very easily performed. As the temporary holding space is on the inlet side of the conductor press-in slot, rearrangement of the cable is unnecessary. All cables are pressed into conductor press-in slots by one operation, after the cables are held in the temporary holding spaces.

According to one embodiment of the present invention, the contact arm of the terminal member has an outward projection which cooperates with a projection of an adjacent terminal member to form another temporary holding space. When a connector has two rows of the terminal members, all the cables are held by two temporarily holding spaces, so that precise positioning and aligning of the cables can be easily performed.

According to another embodiment of the present invention, another pair of the contact arms having pointed ends and a conductor press-in slot are in parallel with the first pair of the contact arms having the temporary holding space. The press-in operation of all cables is easily performed.

BRIEF DESCRIPTION OF THE DRAWINGS

The invention is described in detail below with reference to the accompanying drawings which illustrate specific embodiments, and in which:

FIG. 1(A) is a partially broken perspective view of the basic construction of an electric contact terminal in accordance with the invention;

FIG. 1(B) is a partially broken perspective view of the terminal shown in FIG. 1(A), shown in a position temporarily holding a cable;

FIG. 1(C) is a partially broken perspective view of the terminal shown in FIG. 1(A), shown in a position with the cable a pressed-in;

FIG. 1(D) is a partially broken perspective view of a plurality of the terminals shown in FIG. 1(A), showing another position for temporarily holding the cable;

DETAILED DESCRIPTION OF THE INVENTION

Figure 1:
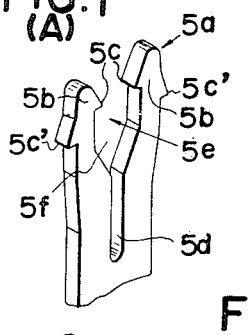
Figure 1:
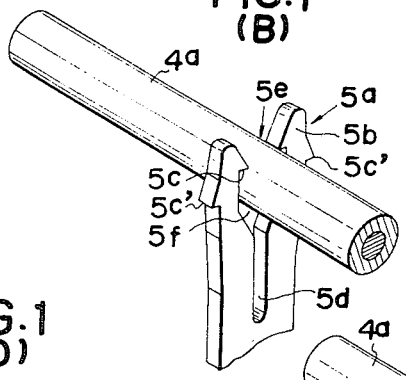
Figure 1:
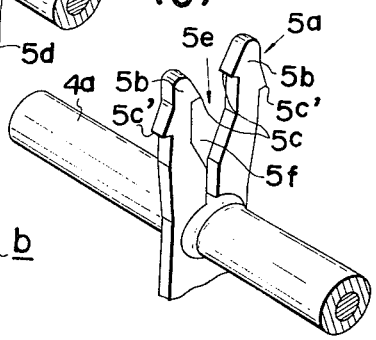
Figure 1:
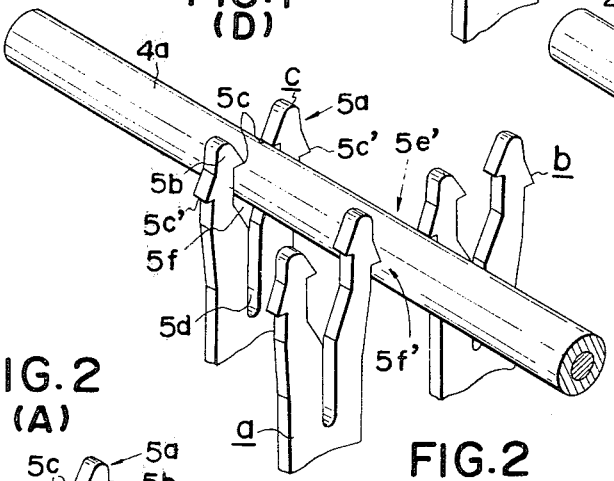

Referring now to FIG. 1, a conductor press-in type electric contact terminal 5*a* is an integrally pressed member formed from a metal plate and has a pair of integral arms 5*b* which form a cable holding slot 5*e* and a conductor press-in slot 5*d* below the cable holding slot 5*e* between the arms 5*b*. The cable holding slot 5*e* has sufficient width to receive a single core cable 4*a* without damaging the insulation of the cable as shown in FIG. 1(B). The arms 5*b* have opposed temporary holding projections 5*c* which project into the cable holding slot 5*e*, to temporarily hold the cable 4*a* in the cable holding slot 5*e*. The arms 5*b* may also have additional temporary holding projections 5*c*' at the outside wall edges, to temporarily hold another cable in cooperation with an adjacent terminal in another temporarily holding space 5*f*' (see FIG. 1(D)). When the cable 4*a* is pressed into the conductor press-in slot 5*d* below the temporary holding slot 5*e*, the insulation of the cable 4*a* is broken, and conductor in the cable is exposed to firmly electrically contact with the walls of the slot 5*d*, as shown in FIG. 1(C). Clearly the opening width between the opposed projections 5*c* or 5*c*' is narrower than diameter of the cable 4*a*. Thus, when the cable 4*a* is pressed in the temporary holding space 5*f* or 5*f*', the cable is held against irregular movement before the press-in process, so that arrangement of the cables before press-in is very easy.

Referring now to FIGS. 2(A) to 2(C), the electric contact terminal 5*a* shown in FIG. 1 contacts with another terminal which has a pair of arms 5*b*'. The terminal 5*a* is integrally connected with the other terminal by a side plate 5*g* from which projects a female terminal 5*h*. The terminals, side plate and the female terminal are formed by press working from a metal plate and are formed into one terminal member. The arms 5b' form a conductor press-in slot 5d' therebetween, and each arm 5b' forms a pointed end 5b'' to break insulation of the cable 4a. As shown in FIG. 2(B), the conductor press-in slot 5d' is below the temporary holding slot 5e between the arms 5b. Thus, the cable 4a is held in the temporary holding space 5f formed by the temporary holding slot 5e and the temporary holding projections 5c, as shown in FIG. 2(C). The female terminal 5h may be a male terminal or a soldered terminal as necessary. In this case, outwardly projected temporary holding projections 5c' are formed to the arms 5b, to hold another cable in cooperation with an adjacent terminal member, as shown in FIG. 1(D). This structure is preferable when two rows of terminal members are arranged and the terminal members of one row are staggered from the terminal members of another row. In this case each cable is temporarily held by the temporary holding projections 5c of one row and by the temporary holding projections 5c' of another row. Thus, each cable is temporarily held in two temporarily holding spaces 5f and 5f'.

Figure 2:
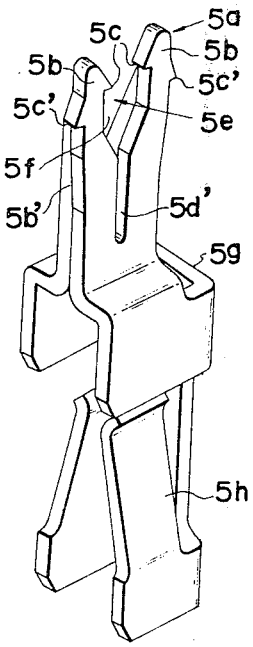
FIG. 2(A) is a perspective view of a second embodiment of the electric contact terminal in accordance with the invention.
FIG. 2(B) is a perspective view of the backside of the terminal shown in FIG. 2(A)
FIG. 2(C) is a partially broken perspective view of the terminal shown in FIG. 2(B), shown in a position temporarily holding a cable.
Figure 2:
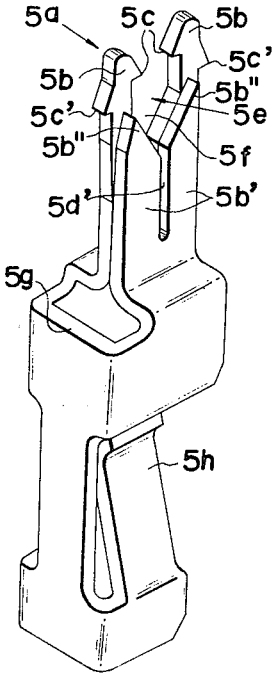
Figure 2:
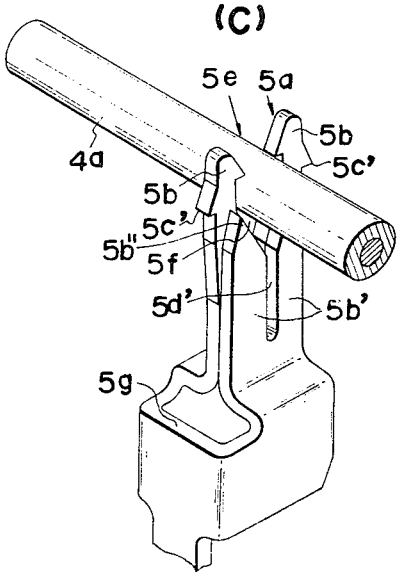
Figure 3:
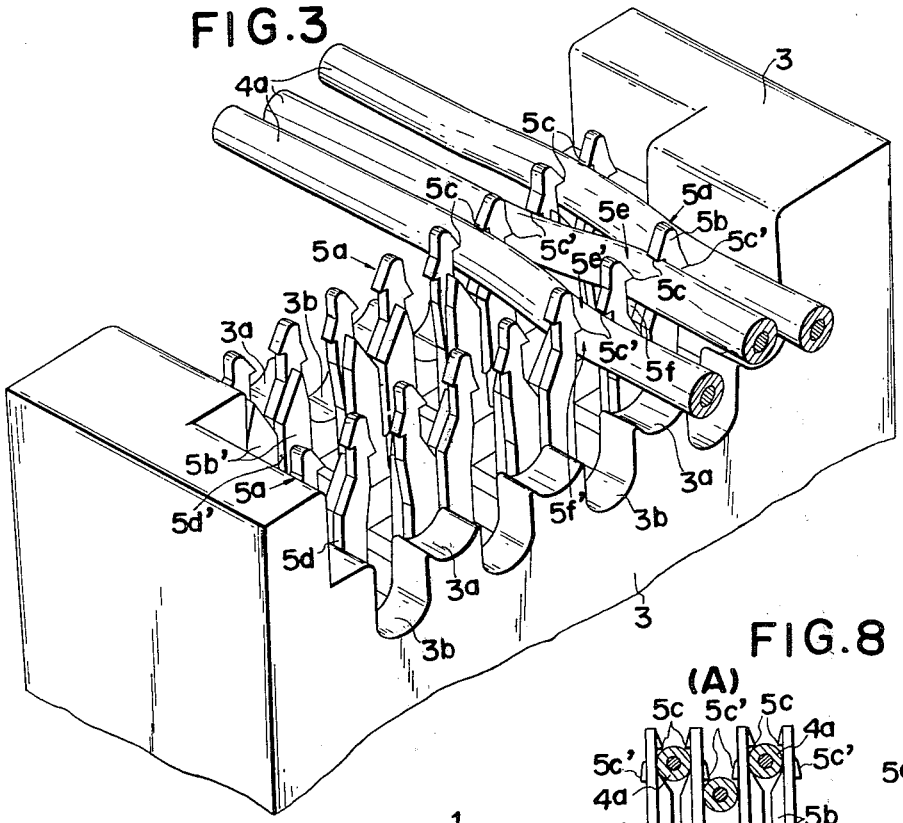
FIG. 3 is a perspective view of an insulating block for an electric connector, showing a plurality of the terminals shown in FIG. 2.
Figure 4:
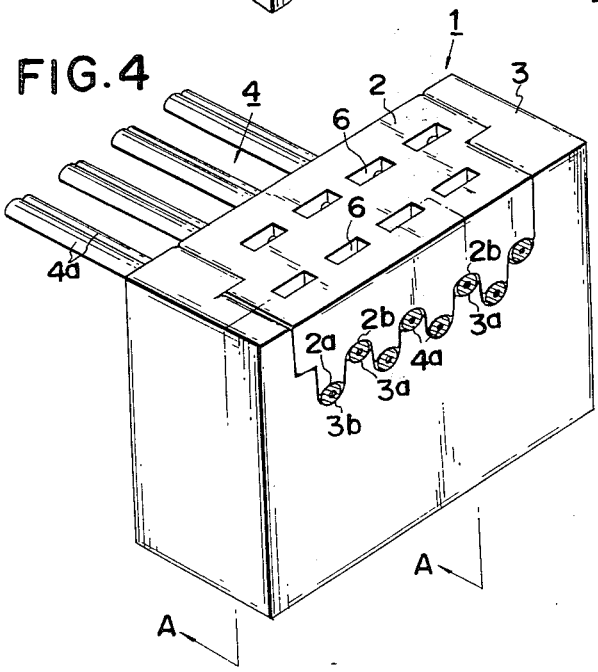
FIG. 4 is a perspective view of the electric connector shown in FIG. 3.
Figure 5:
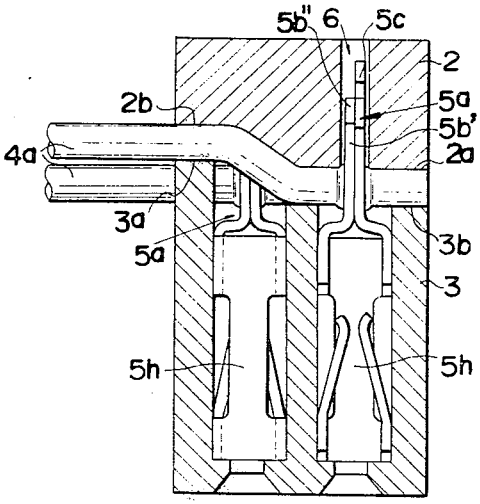
FIG. 5 is a sectional view of the connector shown in FIG. 4, taken along line B—B of FIG. 7.
Figure 6:
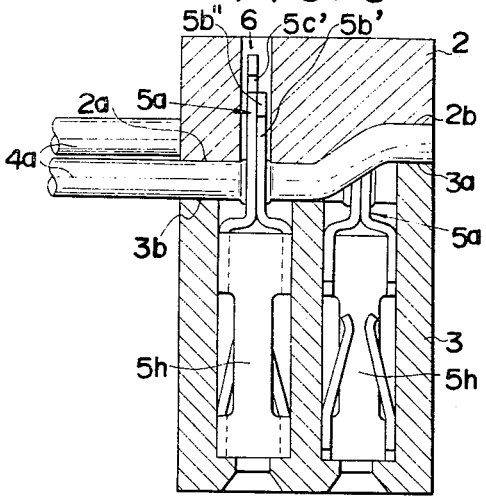
FIG. 6 is a sectional view of the connector shown in FIG. 4, taken along line C—C of FIG. 7.

FIG. 3 shows the lower half of a connector having two rows of the terminal members shown in FIG. 2, and FIG. 4 shows an assembled connector 1 which has a male insulation block 2 and a female insulation block 3 shown also in FIG. 3. The terminal members of one row are staggered from the terminal members of the other row so that each single core cable 4a is held by the temporary holding space 5f of the terminal member of one row and the temporary holding space 5f' between two terminal members of the other row. As shown in FIG. 4, each cable is held between the blocks 2 and 3 in vertically staggered relation with an adjacent cable. The blocks 2 and 3 form vertically staggered high position cable supports 2b and 3a and low position cable supports 2a and 3b. When the blocks 2 and 3 are assembled, one high position cable support of one block cooperates with one low position cable support 2a or 3b of the other block to hold each cable between each opposed high position cable support 2b or 3a and the low position cable support 2a or 3b. Thus, one cable which is pressed in and electrically connected with one of the terminal members of one row is engaged with one of the low position cable supports 3b outside the terminal member and is supported by one of the high position cable supports 2a of the male block 2. As to the same side of the block 3, a cable which is held by the temporary holding space 5f' between the terminal members of the one row and is pressed in and connected with one terminal member of the other row, is supported by the high position cable support 3a of the block 3 and the low position cable support 2b of the other block 2. Thus, as shown in FIGS. 5 and 6, each cable is bent upwards and downwards alternately to form a vertically staggered relation.

To assemble the connector 1, each cable 4a is placed on a desired terminal member of the insulation block 3 and is pressed by fingers of an operator into the temporary holding space 5f of the terminal member and also into the temporary holding space 5f' between the terminal members of the other row. Thus, cables are held in place regularly by the temporary holding projections 5c and 5c'. Then the male insulation block 2 covers the female insulation block 3 and presses the cables into desired positions. Insulations of the cables are destroyed by the pointed ends 5b'' of the arms 5b' of the terminal members, and conductors of the cables are pressed into the conductor press-in slots 5d and 5d' of the terminal members.

Figure 7:
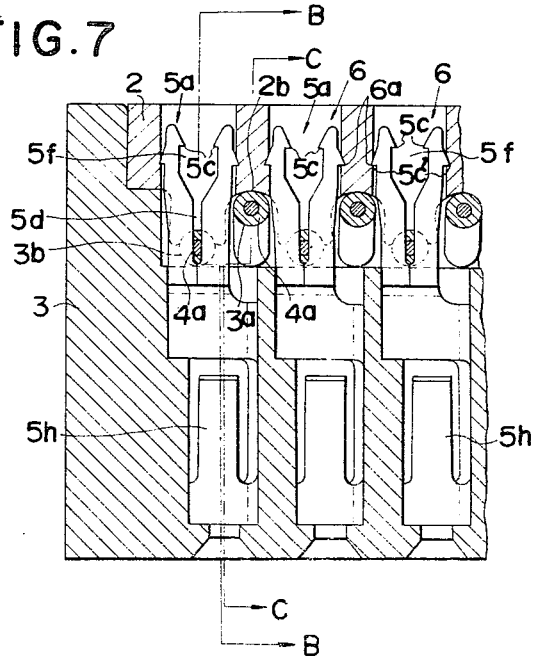
FIG. 7 is a sectional view of the connector shown in FIG. 4, taken along line A—A of FIG. 4.

As shown in FIG. 7, the outside temporary holding projections 5c' of the arms 5b of the terminal members engage elastically with vertical walls of the male insulation block 2 when the blocks 2 and 3 are assembled to form the connector 1, to maintain the connector integral 1 and to prevent rattling between the blocks 2 and 3. In the embodiment shown in FIG. 7, recesses 6 formed between vertical walls of the block 2 each has a width which is slightly narrower than the normal outside width of the terminal member so that when the block 2 presses the cables into the press-in positions, the outer temporary holding projections 5c' engage with the vertical walls of the block 2 by elastic deformation of the arms 5b. At the end of the press-in operation, the projected ends of the projections 5c' engage with stepped recesses 6a which are formed in the vertical walls of the recess 6 of the block 2 by elastic rebounding of the arms 5b of the terminal member. Thus, the blocks 2 and 3 are locked tightly without further means to lock the blocks 2 and 3 to each other.

Figure 8:
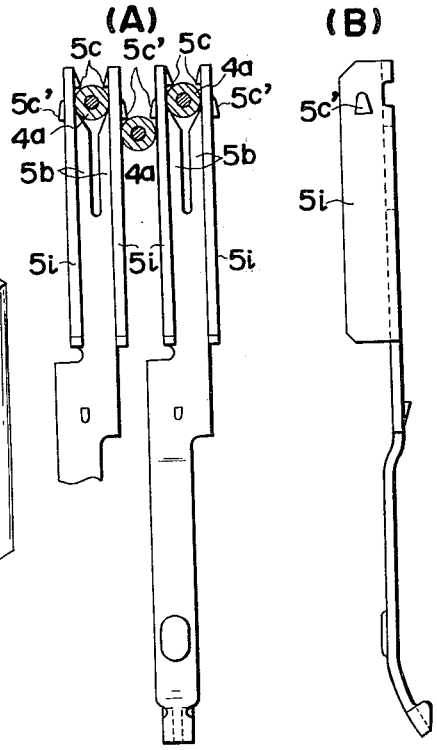
FIG. 8(A) is a partially broken front view of terminals in accordance with another embodiment of the present invention.
FIG. 8(B) is a side view of the terminal shown in FIG. 8(A).

FIG. 8 shows another embodiment of the terminal member in accordance with the invention. In the drawing, the same reference numerals are used to show like elements shown in the drawings of the previous embodiments. The terminal member shown in FIG. 8 also has two arms 5b which form between them a temporary holding slot and a conductor press-in slot as before. The terminal member has side plates 5i which are integrally formed with the arms 5b by being bent perpendicularly to arms 5b. The opposed inside surfaces of the side plates 5i form inwardly projected temporary holding projections 5c and the outside surfaces of the side plates 5i form outwardly projected temporary holding projections 5c'. In this case, dimensions of the projections 5c and 5c' in the longitudinal direction of the cable can be increased as desired to hold the cable safely without damaging the insulation of the cable. The arms 5b are reinforced by the side plates 5i. Inside surfaces of the side plates 5i guide the side surfaces of the cable so that the cable is held in a desired direction in a connector having only one row of the terminal members. Thus, the temporary holding and positioning effects of the cable by the terminal member are substantially increased.

It will be appreciated that a single core cable to be pressed in is temporarily held in the temporary holding space of the terminal member according to the present invention before the cable is pressed into the cable press-in slot 5d or 5d' of the terminal member. Thus, positioning of the cable before the press-in operation is very easily achieved.

When many cables are to be pressed into desired specific terminal members of a connector, the cable arranging operation is easily performed by temporarily holding each cable in a temporary holding space of a specific terminal member before all cables are pressed into desired cable press in slots of the terminal members by one operation. Thus, the assemble operation is substantially simplified.

I claim:

1. An electric contact terminal member for accommodating therein a single core cable having exterior insulation, said terminal member comprising:

a first metal plate having formed therefrom a first pair of contact arms defining therebetween a first slot having an open outer end adjacent outer ends of said first pair of contact arms;

said first slot including an inlet portion extending inwardly from said open outer end of said first slot, said inlet portion being dimensioned to receive and grasp a single core cable including insulation thereof without damage to the insulation;

said first slot including a press-in portion extending inwardly from said inlet portion, said press-in portion being dimensioned to, upon the cable being pressed thereinto, receive the core of the cable, while the cable insulation is broken by facing edges of said first pair of contact arms;

said first pair of arms having adjacent said outer ends thereof integral projection means extending into said inlet portion of said first slot for aiding in grasping the cable;

said inlet portion of said first slot and said projection means forming temporary holding means for enabling accurate positioning of the cable before the cable is pressed into said press-in portion;

a second metal plate having formed therefrom a second pair of contact arms defining therebetween a second slot having an open outer end adjacent outer ends of said second pair of contact arms;

said second metal plate being positioned adjacent said first metal plate, with said second pair of contact arms parallel to said first pair of contact arms, and with said second slot parallel to said first slot;

said second slot being dimensioned to, upon the cable being pressed thereinto, receive the core of the cable, while the cable insulation is broken by facing edges of said second pair of contact arms; and said outer ends of said second pair of contact arms being outwardly pointed to facilitate breaking of the cable insulation upon the cable being pressed from said temporary holding means into said press-in portion of said first slot and into said second slot.

2. A terminal member as claimed in claim 1, wherein said first and second metal plates are in abutting contact with each other.

3. A terminal member as claimed in claims 1 or 2, wherein said first and second metal plates are integrally formed of a single metal element.

4. A terminal member as claimed in claim 1, wherein said first pair of arms have adjacent said outer ends thereof outwardly extending projections for cooperation with adjacent separate terminal members for holding other cables.

* * * * *